US008488798B2

(12) United States Patent
McGrath et al.

(10) Patent No.: US 8,488,798 B2
(45) Date of Patent: Jul. 16, 2013

(54) MATRIX DECODER

(75) Inventors: David McGrath, Rose Bay (AU); Christophe Chabanne, San Mateo, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 565 days.

(21) Appl. No.: 12/811,882

(22) PCT Filed: Jan. 6, 2009

(86) PCT No.: PCT/US2009/030204

§ 371 (c)(1), (2), (4) Date: Jul. 7, 2010

(87) PCT Pub. No.: WO2009/089209

PCT Pub. Date: Jul. 16, 2009

(65) Prior Publication Data

US 2010/0284542 A1 Nov. 11, 2010

Related U.S. Application Data

(60) Provisional application No. 61/010,896, filed on Jan. 11, 2008.

(51) Int. Cl.
*H04R 5/00* (2006.01)

(52) U.S. Cl.
USPC ..... 381/22; 381/1

(58) Field of Classification Search
USPC ..... 381/1, 20, 21, 22
See application file for complete search history.

(56) References Cited

U.S. PATENT DOCUMENTS 4,748,669 A * 5/1988 Klayman ..... 381/1
6,970,567 B1 11/2005 Gundry
7,447,317 B2 11/2008 Herre

FOREIGN PATENT DOCUMENTS

EP 1 362 499 11/2003
JP 2005-223706 8/2005
KR 2004-0012578 2/2004
WO 9957941 A1 11/1999
WO 2007067320 A2 6/2007

OTHER PUBLICATIONS

Jot J. M. et al. , "Spatial Enhancement of Audio Recordings", Proceedings of the International AES Conference, May 23, 2003, pp. 1-11.

* cited by examiner

*Primary Examiner* — Duc Nguyen
*Assistant Examiner* — Kile Blair

(57) ABSTRACT

This audio matrix surround decoder requires minimal digital processing, useful in portable applications, particularly in playback from a portable player using a headphone or loudspeaker virtualizer. In one embodiment it pans inputs Lt and Rt to outputs associated with front directions in response to a measure of the sum of Lt and Rt being greater than a measure of the difference between Lt and Rt, and pans Lt and Rt to outputs associated with rear directions in response to a measure of the sum of Lt and Rt being less than a measure of the difference between Lt and Rt. Lt and Rt are modified to shift the direction of reproduced signals.

15 Claims, 4 Drawing Sheets

MATRIX DECODER

CROSS-REFERENCE TO RELATED APPLICATIONS

This application claims the benefit of priority of U.S. Provisional Application No. 61/010,896, fled Jan. 11, 2008, hereby incorporated by reference.

FIELD OF THE INVENTION

The invention relates to audio signal processing. More particularly the invention relates to an audio matrix decoder or decoding function or to a computer program stored on a computer-readable medium executing the decoding function. Although the decoder or decoding function is particularly useful for playback from a portable player using a headphone or loudspeaker virtualizer, a matrix decoder or decoding function according to aspects of the present invention is not limited to such uses.

SUMMARY OF THE INVENTION

In accordance with an aspect of the present invention, an audio matrix decoding method receiving a stereo signal pair Lt, Rt, in which method the relative amplitudes and polarities of the pair determine the reproduced direction of decoded signals, comprises panning Lt and Rt to outputs associated with front directions in response to a measure of the sum of Lt and Rt being greater than a measure of the difference between Lt and RE, and panning Lt and Rt to outputs associated with rear directions in response to a measure of the sum of Lt and Rt being less than a measure of the difference between Lt and Rt, and modifying Lt and Rt to shift the direction of reproduced signals.

Modifying Lt and Rt to shift the direction of reproduced signals may shift signals panned to outputs associated with rear directions. Modifying Lt and Rt to shift the direction of reproduced signals shifts signals panned to outputs associated with rear directions may shift signals away from the rear-center direction. Such shifting away from the rear-center direction may be in the direction in which such signals have the largest amplitude. Such shifting may progressively decrease for signals at directions increasingly away from the rear-center direction.

Modifying Lt and Rt to shift the direction of reproduced signals may also shift signals panned to outputs associated with front directions. Such shifting of signals panned to outputs associated with front directions may shift least signals at the front-center direction and such shifting may progressively increase for signals at directions increasingly away from the front-center direction.

The degree of shifting, whether to the front or to the rear may be based on a measure of the difference between Lt and Rt.

The degree of shifting may change only when Lt and Rt are panned to outputs associated with rear directions.

According to a further aspect of the present invention, in an audio matrix decoding method receiving a stereo signal pair Lt, Rt, in which method the relative amplitudes and polarities of the pair determine the reproduced direction of decoded signals, a method comprises shifting the direction of outputs associated with front and rear directions to the left or right, the direction of outputs associated with rear directions being shifted to a greater degree than the direction of outputs associated with front directions, wherein the shifting includes modifying the stereo signal pair Lt, Rt by forming a difference signal of Lt and Rt signals, scaling the difference signal by a bias gain factor, and summing the scaled difference signal to both Lt and Rt signals to produce modified Lt and Rt signals such that the relative amplitudes and polarities of the modified Lt and Rt pair determine the reproduced direction of decoded signals.

According to a further aspect of the present invention, a method for modifying a stereo signal pair Lt, Rt before the signal pair is decoded by an audio matrix decoder or decoding method, the relative amplitudes and polarities of the pair determining the reproduced direction of decoded signals comprises modifying the stereo signal pair Lt, Rt by forming a difference signal of Lt and Rt signals, scaling the difference signal by a bias gain factor, and summing the scaled difference signal to both Lt and Rt signals to produce modified Lt and Rt signals such that the relative amplitudes and polarities of the modified Lt and Rt pair determine the reproduced direction of decoded signals.

DESCRIPTION OF THE INVENTION

Front-Back Panning

Figure 1:
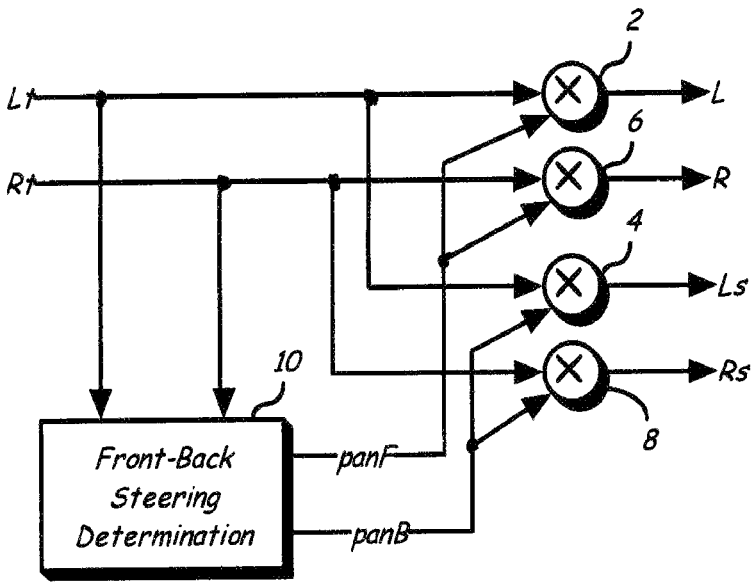
FIG. 1 is a schematic functional block diagram showing an example of how Lt and Rt signals may be panned or steered to front and rear directions in accordance with aspects of the present invention.

The matrix decoder according to aspects of the present invention treats the Lt and Rt signals applied to its inputs as a stereo signal pair, and it pans those signals to the front (left, L and right, R) or to the back (left surround, Ls, and right surround, Rs). Lt and Rt are panned to outputs associated with front directions in response to a measure of the sum of Lt and Rt being greater than a measure of the difference between Lt and Rt. Lt and Rt are panned to outputs associated with rear directions in response to a measure of the sum of Lt and RE being less than a measure of the difference between Lt and Rt. The Front-Back panning may be achieved, for example, as shown in FIG. 1. In this block diagram, the panF and panB signals are slow-changing gain signals (not full bandwidth audio signals) that may vary, for example, between 0 to 1. The panF and panB signals operate together (they are complementary to each other) to effect a smooth crossfade between the L and R front signals and the Ls and Rs back signals.

Referring to FIG. 1, the Lt input signal is applied to the L output via a multiplier or multiplier function 2 and to the Ls output via a multiplier or multiplier function 4. The Rt input signal is applied to the R output via a multiplier or multiplier function 6 and to the Rs output via a multiplier or multiplier function 8. The gain of each of the multipliers 2 and 6 are controlled by the panF gain signal; the gain of each of the multipliers 4 and 8 are controlled by the panB gain signal. The Lt and Rt input signals are also applied to a circuit or function ("Front-Back Steering Determination") 10 that generates the panF and panB signals. Details of the Front-Back Steering Determination are shown in FIG. 2.

Subject to time smoothing, as described below, when the "Front-Back Steering Determination" 10 detects out-of-phase audio but no in-phase audio in the Lt and Rt input signals for a sufficient period of time, it sets panB=1.0 and panF=0.0, thereby directing, panning, or "steering" the Lt and Rt input signals only to the Ls and Rs surround output channels (hard rear steering). Likewise, when there is in-phase audio but no out-of-phase audio present in the input signal for a sufficient period of time, the "Front-Back Steering Determination" 10 sets panB=0.0 and panF=1.0, thereby steering the Lt and Rt input signals only to the front output channels, L and R (hard front steering).

Figure 2:
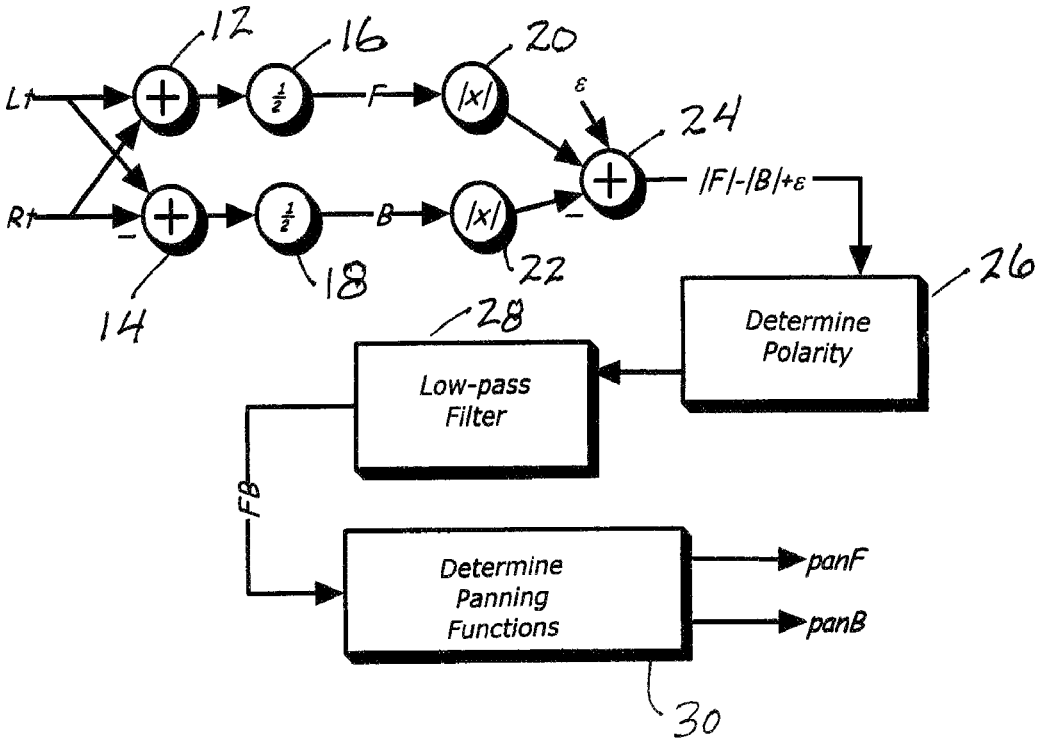
FIG. 2 is a schematic functional block diagram showing an example of the details of the "Front-Back Steering Determination" of FIG. 1.

The arrangement in FIG. 2 generates, on an instantaneous basis, the difference between the magnitudes of the sum and the difference of the input signals Lt and Rt (a rapidly-varying waveform swinging both positively and negatively) and compares it with a small threshold $\epsilon$ (epsilon). This is accomplished by adder or adding function 12 that receives Lt and Rt to produce Lt+Rt at its output, adder or adding function 14 that subtracts Rt from Lt to produce Lt−Rt at its output, scalers or scaling functions 16 and 18 that scale the amplitudes of Lt+Rt and Lt−Rt to produce "Front" and "Back" signals F and B, $$F = \frac{Lt + Rt}{2} \qquad (1)$$

$$B = \frac{Lt - Rt}{2},$$

which signals F and B have their absolute values taken, shown at absolute value devices or functions 20 and 22, and an adder or adding function 24 that subtracts the absolute value of B from the absolute value of F and adds a small value epsilon. Elements 12, 14, 16, 18, 20, 22 and 24 may be considered collectively as a "Difference of Measures of Sum and Difference" device or function as shown in the overall arrangement of FIG. 6.

The polarity of the result $|F|-|B|+\epsilon$ is determined by a "Detect Polarity" device or function 26. If negative, the answer is one value, for example minus 1, if positive, another value, such as zero. Clearly, values other than minus 1 and zero may be employed. The result is a two-valued waveform alternating between two levels, minus 1 and 0, in this example. A low-pass filter or filtering function ("Low-pass Filter") ("LPF") 28 is applied, resulting in a more slowly varying waveform FB that may have any value in the range between or including the values of the two levels, depending on the proportion of time that the square wave spends at each of the levels. In response to real audio signals, the smoothed waveform produced by LPF 28 tends to remain near one or the other of the extremes. In effect, LPF 28 delivers a short-term average of its input, having a time constant, for example, in the range of 5 to 100 milliseconds. Although a 40 millisecond time constant has been found to be suitable, the value is not critical. LPF 28 may be implemented as a single-pole filter.

Still referring to the example of FIG. 2, having determined the intermediate control signal FB, two complementary panning coefficients panF and panB may then be obtained in any of a number of ways by a "Determine Panning Functions" device or function 30. In principle, any of various commonly-used crossfade functions may be employed, such as a linear ramp, log, Hanning, Hamming and sine functions. It will be appreciated that the actual formulae will vary depending on the output values chosen for Detect Polarity 26.

If constant power panning is desired, the following formulae may be employed:

$$panF=\sin(\pi 2*(1+FB)) \qquad (3)$$

$$panB=\cos(\pi/2*(1+FB)) \qquad (4)$$

Alternatively, if constant sound pressure is deemed preferable, or at least acceptable, the following formulae may be employed:

$$panF=1+FB \qquad (5)$$

$$panB=-FB \qquad (6)$$

Although equations 3 and 4 above provide constant power (the sum of the squares of the panF and panB coefficients is one), constant power can be approximated by employing the following formulae:

$$panF=\sin(\pi/2*1+FB)) \qquad (7)$$

$$panB=1-(FB+1)^2 \qquad (8)$$

The values of each of panF and panB in the example of equations 7 and 8 can lie anywhere between 0 and 1 and are complementary to each other, each tracing the path of a parabola. The result is two coefficients or control signals with ranges between 0 and 1, whose squares add approximately to 1.

If panF were consistently greater say than panB in any of the above sets of formulae, which is the result, for example, when Lt and Rt are equal with the same polarity, so that the input to the LPF 28 is 0 over a long time, the panning would steer hard front (panF=1 and panB=0). If panF were consistently smaller than panB, which is the result, for example, when Lt and Rt are equal but out of phase, so that the input to the LPF would be −1 over a long time, the panning would steer hard back (panF=0 and panB=1). On real signals, as with the intermediate signal FB, panning tends to remain either hard front or hard back. Thus, Lt and Rt are panned to outputs associated with front directions in response to a measure of the sum of Lt and Rt being greater than a measure of the difference between Lt and Rt, and Lt and Rt are panned to outputs associated with rear directions in response to a measure of the sum of LtT and Rt being less than a measure of the difference between Lt and Rt. When a measure of the sum of Lt and Rt is the same as a measure of the difference between Lt and Rt, Lt and Rt may be panned to outputs associated with front directions, although this is not critical.

FIG. 2 provides an example of generating suitable panF and panB control signals. Modifications of FIG. 2, for example as suggested above, may be employed. Alternatively, other arrangements that provide smooth panning signals in response to measures of the sum and difference of Lt and Rt may be employed.

Left-Right Panning

Ideally, left-right panning is as follows:

When Lt, Rt is panned to the front (L, R), use less left-right steering than is applied when Lt, RE is panned to the rear, because the Lt, Rt signal likely contains complete L, C, R signal components already mixed into a stereo pair in a manner that is likely to provide a good left-right soundfield when reproduced, including a phantom center image.

When Lt, Rt is panned to the back (Ls, Rs), determine which channel (Ls or Rs) has the greater amplitude, and then modify the Lt, Rt signals so that rear signals are shifted to the side in which such signals have the largest amplitude. As explained further below, in an implementation of the invention, such shifting may also have an effect, albeit a lesser one, when Lt, Rt is panned to the front (L, R).

A common problem in many matrix decoders is the inability to work well for the case where input signals are panned to the rear-center position. This is particularly a problem when playback employs a headphone virtualizer or a loudspeaker virtualizer. The rear-center position, for example, is encoded with Lt and Rt out-of-phase with each other. Hence, when the Lt, RE signals are panned to Ls, Rs, rear-center signals appear in the Ls, Rs signals out-of-phase. A rear phantom image is not formed well by such out-of-phase signals.

Figure 3:
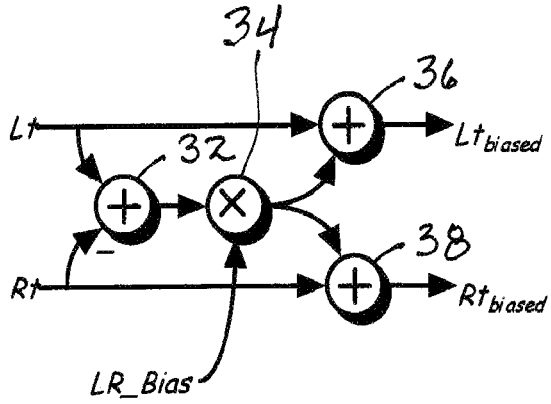
FIG. 3 is a schematic functional block diagram showing an example how Lt and Rt may be modified in accordance with aspects of the present invention.

An aspect of the present invention is to shift Ls, Rs signals to the left or right, thereby avoiding the rear-center phantom position that causes difficulty in imaging. This may be achieved by performing a "shift" operation on the Lt, Rt signals, as shown in FIG. 3 and as described below. The greatest shift may be applied to rear-center signals and less shift for positions progressively away from rear center. The least shift (or no shift) may be applied to front-center signals with a progressively increasing shift for positions away from front-center. In other words shifting should alter the rear-center the most and the front-center the least. By avoiding or minimizing shift at the front-center position under all conditions, image location shifts of voices (dialog), which are usually at the front-center, are avoided or minimized. In principle, a shifting device or function in the manner of the example of FIG. 3 may be employed so as to modify the Lt, Rt input to any two input matrix decoder or decoding function in which the decoder or decoding function operation responds to the relative amplitudes and polarities of Lt and Rt.

Figure 5:
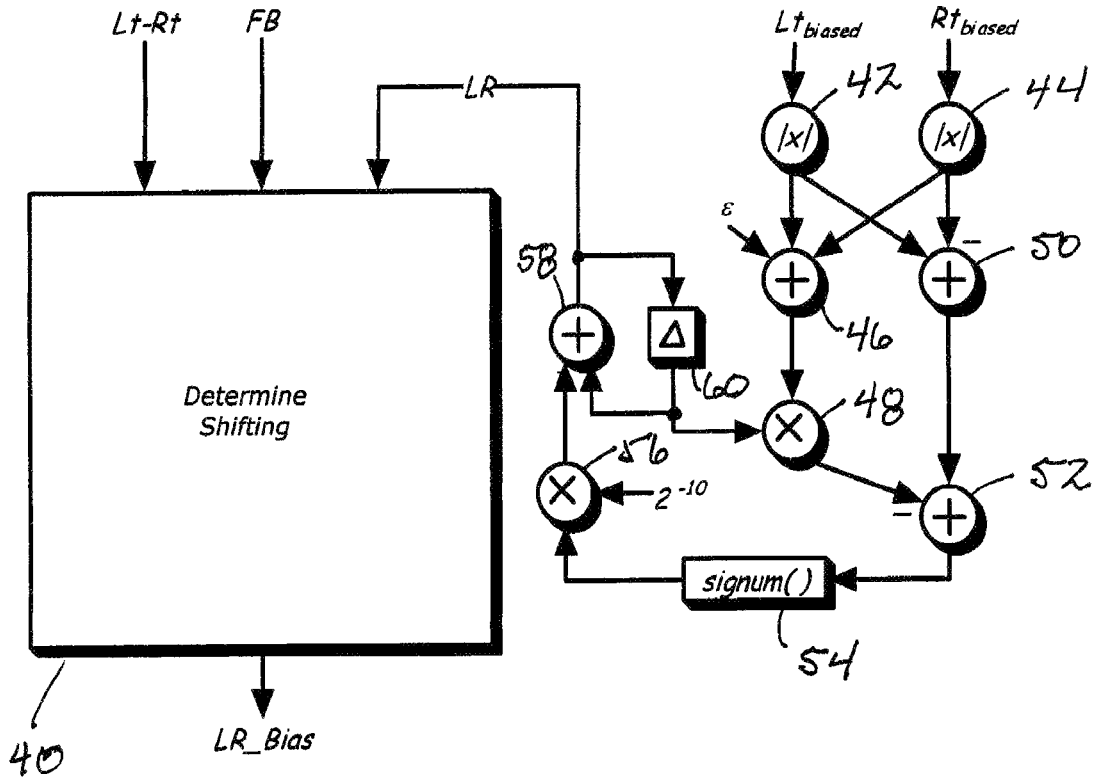
FIG. 5 is a schematic functional block diagram showing an example of how the LR_bias control signal of FIG. 3 may be derived.

One suitable "shift" operation is shown in FIG. 3 in which an Lt−Rt difference signal is generated. Then, a weighted amount of this difference signal is mixed back into both Lt and Rt to produce $Lt_{biased}$ and $Rt_{biased}$. The control input (LR_Bias) may take on a value of +α or −α, depending on whether the "shift" is intended to shift the rear channels to the left or the right. LR_bias may be determined, for example, as shown in the example of FIG. 5. Alpha may have a value, for example, in the range of 0.05 to 0.2. A value of 0.1 has been found to provide useful results.

Referring to the details of FIG. 3, Rt is subtracted from Lt in an adder or adding device 32 to obtain Lt−Rt which is then scaled by LR_bias in a multiplier or multiplying function 34. The scaled version of Lt−Rt is then summed with each of Lt and Rt in respective adders or adding functions 36 and 38 to obtain $Lt_{biased}$ and $Rt_{biased}$.

Consider several examples of the operation of the shifting arrangement of FIG. 3 as follows.

For example, when LR_Bias=+0.1 (indicating that the shift should be to the left), one gets:

$$\begin{aligned} Lt_{biased} &= Lt + [0.1 \times (Lt - Rt)] \\ &= 1.1 \times Lt - 0.1 \times Rt \\ Rt_{biased} &= Rt + [0.1 \times (Lt - Rt)] \\ &= 0.9 \times Rt + 0.1 \times Lt \end{aligned} \tag{9}$$

Continuing with this example (LR_=+0.1), consider the case where the Lt, Rt input signal is composed of a center-panned signal: Lt=Rt=C. In this case, one has:

$$\begin{aligned} Lt &= Rt = C \\ Lt_{biased} &= Lt + [0.1 \times (Lt - Rt)] \\ &= 1.1 \times Lt - 0.1 \times Rt \\ &= 1.1 \times C - 0.1 \times C \\ &= C \\ Rt_{biased} &= Rt + [0.1 \times (Lt - Rt)] \\ &= 0.9 \times Rt + 0.1 \times Lt \\ &= 0.9 \times C + 0.1 \times C \\ &= C \end{aligned} \tag{10}$$

In this case, the $Lt_{biased}$ and $Rt_{biased}$ signals are the same as Lt, Rt. In other words, the shift circuit does not modify the Lt, Rt signals when the input contains only front-center panned audio.

In contrast, consider the case where the Lt, Rt input signal is composed of a rear-center panned signal, S: Lt=S, Rt=−S. In this case, one gets:

$$\begin{aligned} Lt &= S,\ Rt = -S \\ Lt_{biased} &= Lt + [0.1 \times (Lt - Rt)] \\ &= 1.1 \times Lt - 0.1 \times Rt \\ &= 1.1 \times S - 0.1 \times (-S) \\ &= 1.2 \times S \\ Rt_{biased} &= Rt + [0.1 \times (Lt - Rt)] \\ &= 0.9 \times Rt + 0.1 \times Lt \\ &= 0.9 \times (-S) + 0.1 \times S \\ &= -0.8 \times S \end{aligned} \tag{11}$$

In this case, the $Lt_{biased}$ and $Rt_{biased}$ signals are modified by the shift circuit or process, such that $Lt_{biased}$ has been boosted in amplitude, and $Rt_{biased}$ has been reduced in amplitude. Note that, if LR_Bias were set to −0.1 instead of +0.1, the amplitude shifts would be reversed, with $Rt_{biased}$ being boosted in level while $Lt_{biased}$ is reduced.

Figure 4:
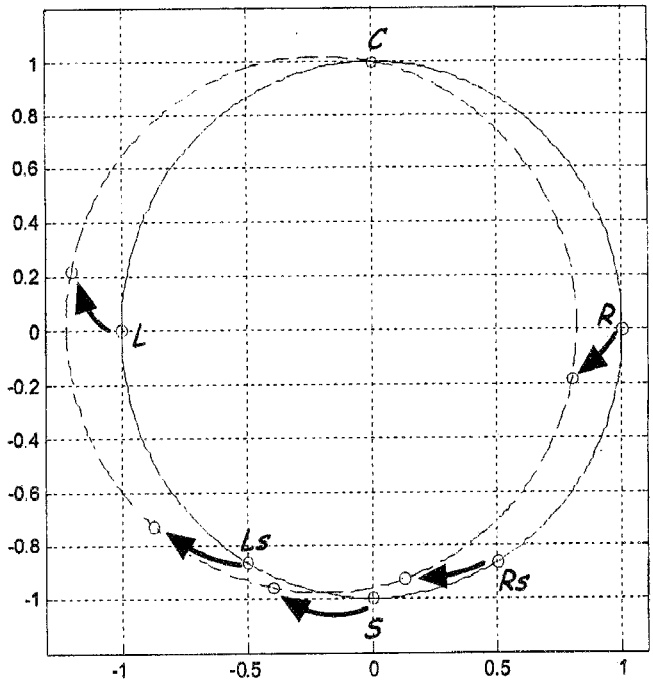
FIG. 4 is a conceptual diagram useful in understanding an effect of modifying the Lt and Rt signals in accordance with aspects of the present invention.

Ideally, the shifting circuit or process operates so that the surround channels are shifted to the left or right, and the front channels are similarly shifted but to a lesser degree. An example of shifting to the left is shown in FIG. 4 in which the solid line circle represents a matrix encoding circle, in which traditional L (left), C (center), R (right), Ls (left surround), S (surround or rear surround), and Rs (right surround) channel positions are shown. This circle has unity radius, reflecting the fact that each channel has unity power. The dashed line circle shows the effect on the unit circle of the shift operation. The shift away from the unit circle indicates that the power of some signal directions has been boosted or attenuated. In particular, note that the rear-center position S is shifted by the greatest amount with progressively less shifting for directions farther and farther away from S with no shifting occurring at the front-center position C.

An example of a way to determine a suitable LR_bias signal is shown in FIG. 5. The LR_bias signal is based principally on LR, a short-term-averaged amplitude difference between the $Lt_{biased}$ and $Rt_{biased}$ signals. In other words, LR is an estimate of $Lt_{biased}$ versus $Rt_{biased}$. LR_Bias is calculated in "Determine Shifting" device or function 40 in response to whether each of LR, FB (FIG. 2) is less than or greater than a threshold, and in response to Lt−Rt. Such a calculation may be expressed in programming pseudocode:

```
If ( zero_crossing (Lt−Rt) &&
        (FB < 0.1) ) {
    if (LR<−0.1) {
        Bias =− 0.1;
    }
    if (LR>0.1) {
        Bias = 0.1;
    }
}
```

Alternatively, FB and LR may be multiplied and the bias determined by whether the result is greater than a threshold. Such calculation may be expressed in programming pseudocode:

```
If ( zero_crossing (Lt−Rt) &&
    if (LR*FB<−0.01) {
        Bias =+ 0.1;
If ( zero_crossing (Lt−Rt) &&
    if (LR*FB>0.01) {
        Bias = −0.1;
    }
}
```

The LR_bias signal may be determined as follows. First measure the relative amplitude of the $Lt_{biased}$ and $Rt_{biased}$ signals. Intermediate signal, LR, an estimate of $Lt_{biased}$ versus $Rt_{biased}$, a short-term-averaged amplitude difference between the $Lt_{biased}$ and $Rt_{biased}$ signals, may be determined as follows:

$$LR = \frac{avg(|Lt_{biased}| - |Rt_{biased}|)}{avg(|Lt_{biased}| + |Rt_{biased}| + \varepsilon)} \tag{12}$$

Note that a small positive offset, ϵ (epsilon), is added to the denominator of the fraction in equation 7, to ensure that no error occurs when Lt and Rt are both zero. In order to estimate LR, one notes that the correct value of LR should result in $Error_{LR}$ being equal to zero:

$$Error_{LR} = avg(|Lt_{biased}| - |Rt_{biased}|) - LR \times \{avg(|Lt_{biased}| + |Rt_{biased}| + \epsilon)\} = 0 \tag{13}$$

One way to create the short-term smoothed value of LR is to increment or decrement the instantaneous value of the amplitude difference between the $Lt_{biased}$ and $Rt_{biased}$ signals (by a small increment, such as $2^{-10}$), based on the value of $Error_{LR}$, as follows:

$$LR' = \begin{cases} LR + \frac{1}{1024} & (Error_{LR} \geq 0) \\ LR - \frac{1}{1024} & (Error_{LR} < 0) \end{cases} \tag{14}$$

In this way, the next value of LR (referred to as LR' in the equation above), will move towards the correct value in a stair step manner.

The short-term smoothing or averaging (reflected in equations 1.5 and 1.6 as "avg") is a result of the smoothing that results from the incremental steps that attempt to reduce the LR error. The smoothing may have a time constant between about 5 and 100 milliseconds. Values of 20 and 40 milliseconds have been found to be useful. In the implementation described, LR can take on values from −1 (indicating a hard left pan) to +1 (indicating a hard right pan). LR may have an initial value of zero, thus requiring 1024 increments for it to reach +1 or −1. Obviously, 2048 increments are required for LR to go from hard left to hard right.

If implemented in a digital system, the increments and decrements may be done at the audio bit rate (48 kHz, for example, when increments of $2^{-10}$ are employed). In principle, the present invention may be implemented wholly or partly in the analog domain.

Referring again to FIG. 5, $Lt_{biased}$ and $Rt_{biased}$ have their absolute values taken, shown at absolute value devices or functions 42 and 44. An adder or adding function 46 adds the absolute value of $Lt_{biased}$ and the absolute value $Rt_{biased}$ to the small value epsilon and applies the result to a multiplier or multiplier function 48 that also receives a one-sample-delayed version of LR to produce the product of LR and the sum of the absolute value of $Lt_{biased}$, the absolute value $Rt_{biased}$, and epsilon. An adder or adding function 50 subtracts the absolute value of $Rt_{biased}$ from the absolute value of $Lt_{biased}$. The error signal (equation 8) is then obtained from the output of adder or adding function 52. The error signal is applied to signum( ) device or function 54 that produces +1 if the input is greater than zero, −1 if the input is less than zero, and 0 if the input is zero (although some DSP implementations of such a function are simplified, so that signum ( ) may be +1 for an input that is greater than or equal to zero, and −1 for negative input). The signum device or function 54 output is multiplied by the $2^{10}$ scaling factor in multiplier or multiplying function 56 and summed with the one-sample-delayed version of LR (provided by delay device or function 60) in adder or adding function 58. Elements 42, 44, 46, 48, 50, 52, 54, 56. 59 and 60 may be considered collectively as a "Determine Short-Term Averaged Difference" device or function as shown in the overall arrangement of FIG. 6.

Once the value of LR has been determined, the LR_Bias signal value is updated in Determine Shifting 40 according to the pseudocode shown first above and the following logical rules:

1. LR_Bias will always be equal to +α or −α, where α is in the range of, for example, 0.05 to 0.2. In practice, a value of 0.1 has been found to provide useful results.
2. The LR_Bias signal only flips between its two allowable values when there is a zero-crossing in the Lt−Rt signal. This minimizes the possibility that a change in LR_Bias will result in an audible click in the output.
3. When the LR signal indicates that $Lt_{biased}$ is greater in amplitude than $Rt_{biased}$ (when LR>0), and when the FB signal indicates that the Lt, Rt signals should be panned towards the back by more than an appropriate threshold (for example, when FB<−0.1), then set LR_Bias to +0.1 (when there is a zero-crossing in the Lt−Rt difference signal). In other words, the value of LR_Bias is allowed to change when the Lt, Rt signals are panned to the back by more than a threshold. However, the latest value of LR_Bias remains effective whether or not the Lt, Rt signals are panned to the back or panned to the front.
4. When the LR signal indicates that $Rt_{biased}$ is greater in amplitude than $Lt_{biased}$ (when LR<0), and when the FB signal indicates that the Lt, Rt signals should be panned towards the back by more than a threshold (for example, when FB<−0.1 as mentioned above), then set LR_Bias to −0.1 (when there is a zero-crossing in the Lt−Rt difference signal). The manner in which LR=0 is handled is not critical. One possibility is that when LR=0 do nothing (leave LR_bias unchanged) or, alternatively, act as when LR>0 as described just above in paragraph 3.

Note that the LR_Bias signal is determined from the amplitudes of the $Lt_{biased}$ and $Rt_{biased}$ signals, and the $Lt_{biased}$ and $Rt_{biased}$ signal are modified by the LR_Bias signal, thus forming a feedback loop in the overall algorithm. This is a positive feedback loop that makes the overall behavior bi-stable in nature. As a result, the arrangement exhibits hysteresis. For example, when LR_=+0.1, this causes the shifting circuit to exaggerate the $Lt_{biased}$ signal, boosting it proportionally in comparison to the $Rt_{biased}$ signal which will, in turn, increase the LR signal (pushing it upwards in a positive direction). As a result, a much larger Rt signal (relative to Lt) is required to flip LR_Bias back to −0.1. Such hysteresis ensures that the system is less likely to exhibit rapid flipping back and forth in the LR_Bias signal, which might otherwise be undesirable by causing audible artifacts such as image shifting.

Image shifting is also minimized by allowing LR_bias to change only when the pan is to the rear. Image shifts are more noticeable when at the front. Also, retaining the same shift when panning from rear to front and from front to rear avoids image shifts when such pans occur. However, changes in LR_bias typically will occur when a change in audio content occurs. Thus, a shift in image location is often required at such a change and is desirable.

It will be noted that both the front-back panning and left-right panning employ time constants. Although suggested values for such time constants has been given, it will be understood that smoothing values are to a degree a matter of the designer's taste and may be chosen by trial and error. In addition, desirable smoothing values may vary depending on the audio content.

Figure 6:
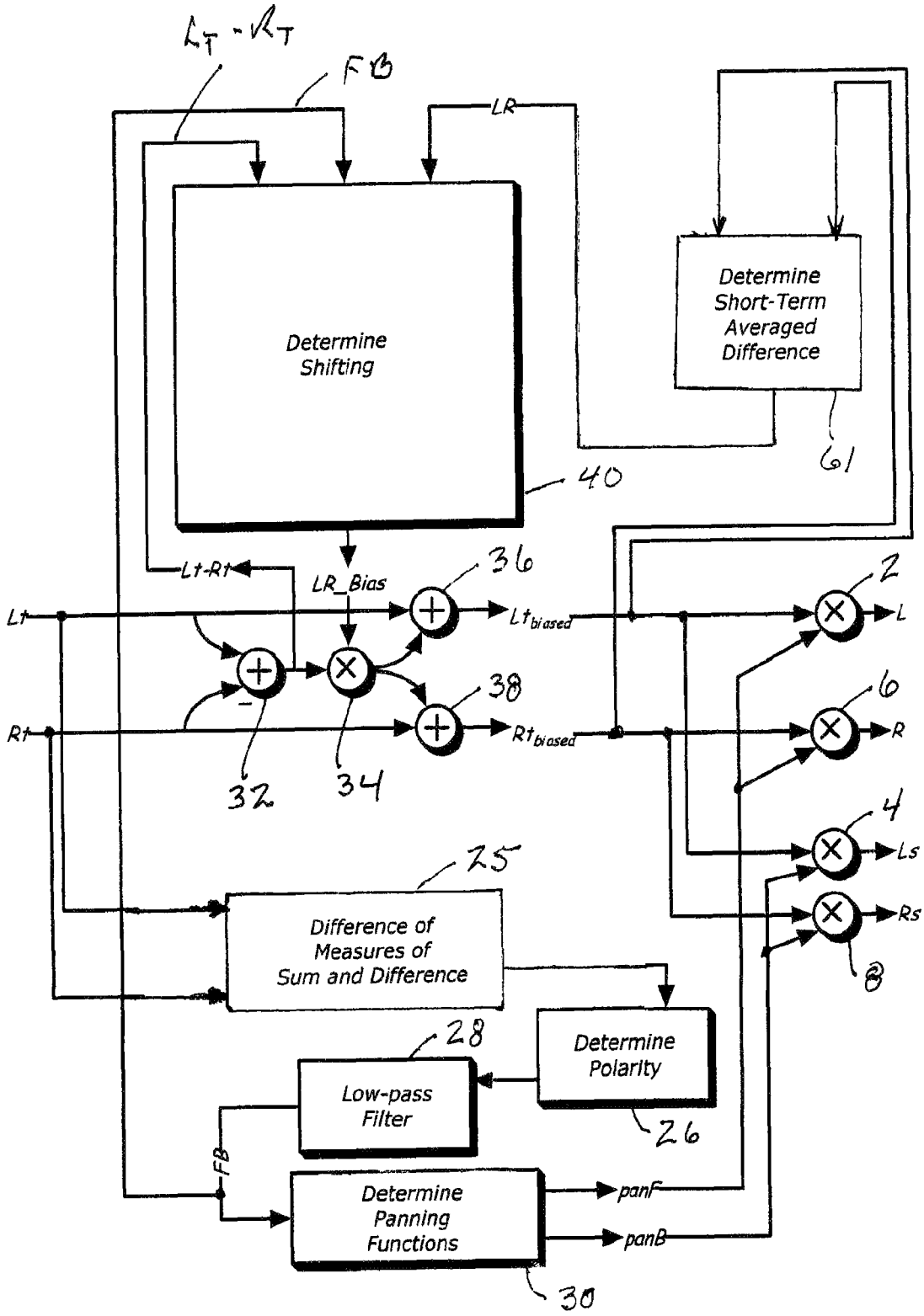
FIG. 6 is a schematic functional block diagram showing the overall arrangement of the arrangements of FIGS. 1, 2, 3, and 5.

FIG. 6 shows the manner in which the above-described FIGS. 1, 2, 3 and 5 fit together.

Implementation

Although in principle the invention may be practiced either in the analog or digital domain (or some combination of the two), in practical embodiments of the invention, audio signals are represented by samples in blocks of data and processing is done in the digital domain.

The invention may be implemented in hardware or software, or a combination of both (e.g., programmable logic arrays). Unless otherwise specified, algorithms and processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

We claim:

1. An audio matrix decoding method receiving a stereo signal pair Lt, Rt, in which method the relative amplitudes and polarities of the pair determine the reproduced direction of decoded signals, comprising panning Lt and Rt to outputs associated with front directions in response to a measure of the sum of Lt and Rt being greater than a measure of the difference between Lt and Rt, and panning Lt and Rt to outputs associated with rear directions in response to a measure of the sum of Lt and Rt being less than a measure of the difference between Lt and Rt, and modifying the stereo signal pair Lt and Rt to shift the direction of reproduced signals by forming a difference signal of Lt and Rt signals, scaling said difference signal by a bias gain factor, and summing said scaled difference signal to both Lt and Rt signals to produce modified Lt and Rt signals such that the relative amplitudes and polarities of the modified Lt and Rt pair determine the reproduced direction of decoded signals.

2. A method according to claim 1 wherein modifying Lt and Rt to shift the direction of reproduced signals shifts signals panned to outputs associated with rear directions.

3. A method according to claim 2 wherein modifying Lt and Rt to shift the direction of reproduced signals shifts signals panned to outputs associated with rear directions so as to shift signals away from the rear-center direction.

4. A method according to claim 3 wherein signals panned to outputs associated with rear directions are shifted to away from the rear-center direction in the direction in which such signals have the largest amplitude.

5. A method according to claim 3 wherein the degree of shifting is greatest for signals at the rear-center position, the shifting progressively decreasing for signals at directions increasingly away from the rear-center direction.

6. A method according to claim 2 wherein modifying Lt and Rt to shift the direction of reproduced signals also shifts signals panned to outputs associated with front directions.

7. A method according to claim 6 wherein modifying Lt and Rt to shift the direction of reproduced signals shifts signals panned to outputs associated with front directions so as to shift least signals at the front-center direction.

8. A method according to claim 7 wherein the degree of shifting is least for signals at the front-center position, the shifting progressively increasing for signals at directions increasingly away from the front-center direction.

9. A method according to claim 1 wherein the degree of shifting is based on a measure of the difference between Lt and Rt.

10. A method according to claim 1 wherein the degree of shifting changes only when Lt and Rt are panned to outputs associated with rear directions.

11. Apparatus adapted to perform the method of claim 1.

12. A non-transitory computer-readable medium comprising a computer program, thereon, for causing a computer to perform the method of claim 1.

13. In an audio matrix decoding method receiving a stereo signal pair Lt, Rt, in which method the relative amplitudes and polarities of the pair determine the reproduced direction of decoded signals, a method comprising shifting the direction of outputs associated with front and rear directions to the left or right, the direction of outputs associated with rear directions being shifted to a greater degree than the direction of outputs associated with front directions, wherein said shifting includes modifying the stereo signal pair Lt, Rt by forming a difference signal of Lt and Rt signals, scaling said difference signal by a bias gain factor, and summing said scaled difference signal to both Lt and Rt signals to produce modified Lt and Rt signals such that the relative amplitudes and polarities of the modified Lt and Rt pair determine the reproduced direction of decoded signals.

14. A method for modifying a stereo signal pair Lt, Rt before the signal pair is decoded by an audio matrix decoder or decoding method, the relative amplitudes and polarities of the pair determining the reproduced direction of decoded signals, comprising modifying the stereo signal pair Lt, Rt by forming a difference signal of Lt and Rt signals, scaling said difference signal by a bias gain factor, and summing said scaled difference signal to both Lt and Rt signals to produce modified Lt and Rt signals such that the relative amplitudes and polarities of the modified Lt and Rt pair determine the reproduced direction of decoded signals.

15. An audio matrix decoding method receiving a stereo signal pair Lt, Rt, in which method the relative amplitudes and polarities of the pair determine the reproduced direction of decoded signals, comprising panning Lt and Rt to outputs associated with front directions in response to a measure of the sum of Lt and Rt being greater than a measure of the difference between Lt and Rt, and panning Lt and Rt to outputs associated with rear directions in response to a measure of the sum of Lt and Rt being less than a measure of the difference between Lt and Rt, and modifying Lt and Rt to shift the direction of reproduced signals, wherein said modifying includes shifting the direction of outputs associated with front and rear directions to the left or right, the direction of outputs associated with rear directions being shifted to a greater degree than the direction of outputs associated with front directions, wherein said shifting includes modifying the stereo signal pair Lt, Rt by forming a difference signal of Lt and Rt signals, scaling said difference signal by a bias gain factor, and summing said scaled difference signal to both Lt and Rt signals to produce modified Lt and Rt signals such that the relative amplitudes and polarities of the modified Lt and Rt pair determine the reproduced direction of decoded signals.

* * * * *